US008727012B2

(12) United States Patent
Bhat

(10) Patent No.: US 8,727,012 B2
(45) Date of Patent: May 20, 2014

(54) GASKET TEST PROTECTOR SLEEVE FOR SUBSEA MINERAL EXTRACTION EQUIPMENT

(75) Inventor: Venkatesh Bhat, Houston, TX (US)

(73) Assignee: Cameron International Corporation, Houston, TX (US)

( * ) Notice: Subject to any disclaimer, the term of this patent is extended or adjusted under 35 U.S.C. 154(b) by 317 days.

(21) Appl. No.: 13/090,880

(22) Filed: Apr. 20, 2011

(65) Prior Publication Data

US 2012/0111573 A1 May 10, 2012

Related U.S. Application Data

(60) Provisional application No. 61/411,418, filed on Nov. 8, 2010.

(51) Int. Cl.
*E21B 7/12* (2006.01)

(52) U.S. Cl.
USPC ..... 166/338; 166/340; 166/351; 166/368

(58) Field of Classification Search
USPC ..... 166/338–340, 351, 358, 368, 381, 85.3; 285/123.1
See application file for complete search history.

(56) References Cited

U.S. PATENT DOCUMENTS 3,971,576 A * 7/1976 Herd et al. ..... 285/87
4,346,919 A * 8/1982 Morrill ..... 285/25
4,703,774 A * 11/1987 Seehausen ..... 137/614.04
4,872,708 A * 10/1989 Abreo, Jr. ..... 285/39
4,921,284 A * 5/1990 Singeetham ..... 285/415
5,044,438 A * 9/1991 Young ..... 166/382
5,819,851 A * 10/1998 Dallas ..... 166/308.1
5,865,250 A * 2/1999 Gariepy ..... 166/375
5,941,310 A * 8/1999 Cunningham et al. ..... 166/345
6,003,602 A * 12/1999 Wilkins ..... 166/339
6,039,120 A * 3/2000 Wilkins et al. ..... 166/368
6,119,773 A * 9/2000 Gariepy et al. ..... 166/88.1
6,170,578 B1 * 1/2001 Edwards et al. ..... 166/339
6,227,300 B1 * 5/2001 Cunningham et al. ..... 166/339
6,244,348 B1 * 6/2001 Gariepy et al. ..... 166/375
6,289,993 B1 * 9/2001 Dallas ..... 166/386
6,293,345 B1 * 9/2001 Watkins ..... 166/368
6,470,968 B1 * 10/2002 Turner ..... 166/348
6,659,181 B2 * 12/2003 Hartmann ..... 166/348
6,769,489 B2 * 8/2004 Dallas ..... 166/386
6,823,942 B1 * 11/2004 McGee ..... 166/379
6,918,441 B2 * 7/2005 Dallas ..... 166/202
6,920,925 B2 7/2005 Duhn et al.
6,966,381 B2 * 11/2005 Stjernstrom et al. ..... 166/337
7,066,269 B2 * 6/2006 Dallas et al. ..... 166/379
7,308,934 B2 * 12/2007 Swagerty et al. ..... 166/177.5

(Continued)

OTHER PUBLICATIONS

PCT Search Report and Written Opinion for PCT/US2011/033289, mailed on Sep. 28, 2012.

*Primary Examiner* — Matthew Buck
*Assistant Examiner* — Aaron Lembo
(74) *Attorney, Agent, or Firm* — Fletcher Yoder, P.C.

(57) ABSTRACT

A gasket test protector sleeve is provided for subsea mineral extraction equipment. The gasket test protector sleeve includes a gasket test isolation portion. The gasket test isolation portion is configured to isolate a gasket between a first tubular and a second tubular of a subsea mineral extraction system. The bore protection portion is configured to protect a first bore of the first tubular during downhole procedures.

19 Claims, 4 Drawing Sheets

(56) References Cited

U.S. PATENT DOCUMENTS

| | | | | |
|---|---|---|---|---|
| 7,322,407 | B2 | 1/2008 | Duhn et al. | |
| 7,416,020 | B2 * | 8/2008 | Duhn et al. | 166/75.13 |
| 7,422,070 | B2 * | 9/2008 | Dallas et al. | 166/382 |
| 7,493,944 | B2 | 2/2009 | Duhn et al. | |
| 7,520,322 | B2 * | 4/2009 | Duhn et al. | 166/75.13 |
| 7,614,448 | B2 * | 11/2009 | Swagerty et al. | 166/177.5 |
| 7,644,757 | B2 * | 1/2010 | Artherholt | 166/113 |
| 7,647,973 | B2 * | 1/2010 | Minassian et al. | 166/338 |
| 7,708,061 | B2 * | 5/2010 | McGuire et al. | 166/202 |
| 7,721,808 | B2 * | 5/2010 | Dallas et al. | 166/379 |
| 7,726,393 | B2 | 6/2010 | Duhn et al. | |
| 7,789,133 | B2 * | 9/2010 | McGuire | 166/90.1 |
| 7,857,062 | B2 * | 12/2010 | Dallas | 166/379 |
| 7,900,697 | B2 * | 3/2011 | Swagerty et al. | 166/177.5 |
| 7,905,293 | B2 * | 3/2011 | Dallas et al. | 166/379 |
| 7,909,103 | B2 * | 3/2011 | Fenton | 166/348 |
| 7,921,923 | B2 * | 4/2011 | McGuire | 166/379 |
| 7,922,216 | B2 * | 4/2011 | Dallas et al. | 285/354 |
| 8,157,005 | B2 * | 4/2012 | McGuire | 166/88.1 |
| 8,272,433 | B2 | 9/2012 | Duhn et al. | |
| 8,302,678 | B2 * | 11/2012 | Swagerty et al. | 166/177.5 |
| 8,322,440 | B2 * | 12/2012 | Christie | 166/368 |
| 8,322,441 | B2 * | 12/2012 | Fenton | 166/368 |
| 8,333,237 | B2 | 12/2012 | Duhn et al. | |
| 2003/0192698 | A1 * | 10/2003 | Dallas | 166/307 |
| 2003/0205385 | A1 | 11/2003 | Duhn et al. | |
| 2006/0185841 | A1 | 8/2006 | Swagerty et al. | |
| 2008/0230226 | A1 | 9/2008 | Lam et al. | |
| 2008/0277120 | A1 | 11/2008 | Hickie | |
| 2009/0211749 | A1 | 8/2009 | Nguyen et al. | |
| 2013/0068447 | A1 | 3/2013 | Duhn et al. | |

* cited by examiner

GASKET TEST PROTECTOR SLEEVE FOR SUBSEA MINERAL EXTRACTION EQUIPMENT

CROSS REFERENCE TO RELATED APPLICATION

This application claims priority to U.S. Provisional Patent Application No. 61/411,418, entitled "Gasket Test Protector Sleeve for Subsea Mineral Extraction Equipment", filed on Nov. 8, 2010, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are often used to access resources below the surface of the earth. For instance, oil, natural gas, and other minerals are often extracted via a well. Due to the value of these subsurface resources, wells are drilled at great expense, and great care is typically taken to protect the costly equipment and the environment. Some of the equipment used to extract oil include a wellhead and a tree. The tree attaches to the wellhead and controls the flow of oil to the surface. After a connection is made between the tree and the wellhead, the connection may be tested for leaks prior to production fluid exposure (e.g., oil). Unfortunately, the test equipment is fixed to the tree; and thus is not independently extractable in the event of problems.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed in detail below, the disclosed embodiments include a gasket test protector sleeve. The gasket test protector sleeve combines a gasket test isolation portion and a bore protection portion into a single integrated apparatus, which is extractable independent from wellhead equipment (e.g., wellhead, tree, etc.). In operation, the gasket test portion is configured to isolate a gasket or seal between a wellhead and a tree for testing. If the gasket fails to deliver a fluid tight connection between the wellhead and tree, then the testing identifies the leak (or pressure loss) to avoid oil escaping into the environment. Furthermore, the bore protection portion protects the tree from damage during various downhole operations (e.g., drilling). Advantageously, the combination of the two portions into a single integrated apparatus permits their extraction before oil production begins. Because both portions are extracted, the portions may be reused at other tree installation sites. Furthermore, if the fluid tight connection between the tree and wellhead fails, then the gasket test protector sleeve may be withdrawn to the surface for inspection to ensure it was not the cause of the test failure. Without this ability, the tree would have to be unhooked and pulled to the surface for inspection. Accordingly, the ability to inspect the gasket test protector sleeve before unhooking the tree may save time and effort.

Figure 1:
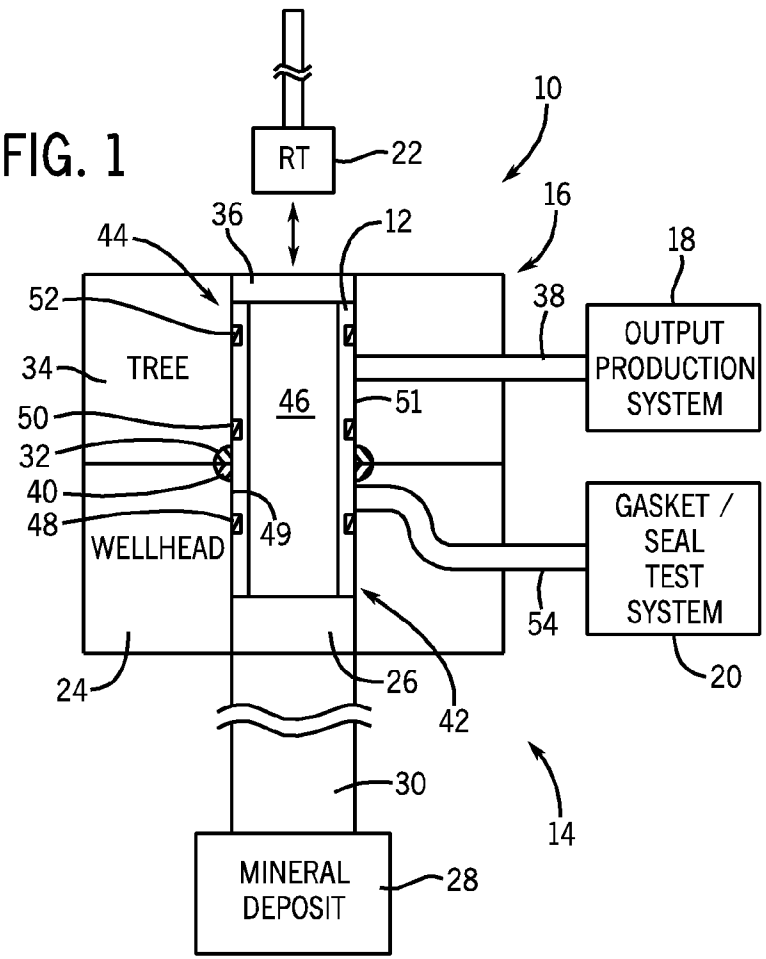
FIG. 1 is a block diagram of an embodiment of a mineral extraction system with a gasket test protector sleeve.

FIG. 1 is a block diagram of an embodiment of a mineral extraction system 10 having a gasket test protector sleeve 12. The oil exploration process involves complex equipment for identifying potential oil fields. Once a field is identified in a subsea environment, a well is drilled to verify the presence of oil. If the well confirms the presence of oil, the well is plugged until exploitation of the field is possible (i.e., arrival and installation of mineral extraction system 10). The illustrated mineral extraction system 10 can be configured to extract various minerals or natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes the gasket test protector sleeve 12, wellhead 14, a tree 16, an output production system 18, a gasket/seal test system 20, and a gasket test protector sleeve retrieval tool 22.

The wellhead 14 defines a body 24 and a bore aperture 26 through the body 24. The wellhead 14 communicates with a mineral deposit 28 via a well-bore 30 and provides for a sealable connection thereto. With the wellhead 14 secured to the well-bore 30, extraction of minerals from the mineral deposit 28 is possible through the bore aperture 26. However, prior to production, a tree 16 is securely attached to the wellhead 14 to control the flow of minerals out of the well.

The attachment of the tree 16 enables a controlled flow of minerals (e.g., oil) from the well to the surface. The tree 16 includes a gasket 32 or seal, body 34, bore aperture 36, and production outlet 38. The gasket 32 (e.g., annular gasket) provides a fluid tight seal 40 between the wellhead 14 and the tree 16. The fluid tight seal 40 allows oil to travel through the wellhead 14 into the tree 16 without leakage. For example, after removal of the sleeve 12, the oil may travel through the production outlet 38 and into the output production system 18. The fluid tight seal 40 ensures that oil does not escape the mineral extraction system 10 and enter the surrounding environment. Thus, with the fluid tight seal 40, the output production system 18 is able to control the oil flow to the surface through a combination of valves.

The mineral extraction system 10 uses the gasket test protector sleeve 12 with the gasket seal test system 20 to ensure that the gasket 32 creates a proper seal 40 between the wellhead 14 and the tree 16. The gasket test protector sleeve 12 defines gasket test isolation portion 42, a bore protection portion 44, a central aperture 46 (e.g., for downhole operations), and three seals or gaskets 48, 50, and 52 (e.g., annular gaskets). In other embodiments, there may be more than three gaskets, e.g., 3, 4, 5, 6, 7, 8, 9, 10, or more gaskets. As illustrated, once the sleeve 12 is placed within the bore apertures 26 and 36, the seals 48, 50, and 52 create fluid tight seals between the sleeve 12, the wellhead body 24, and the tree body 34. In particular, the gasket 48 and 50 (e.g., annular gasket) on the gasket test isolation portion 42 define a seal test region (e.g., annular region) 49, which includes or extends to the gasket 32 and a gasket seal test system line 54. Similarly, the gaskets 50 and 52 (e.g., annular gaskets) of the bore protection portion 44 define a seal region (e.g., annular region) 51, which includes or extends to the output aperture 38. As explained above, the sleeve 12 may include more gaskets to create a seal around line 54 and production aperture 38. For example, the additional gaskets may be duplicative gaskets in the event the others fail.

With the gaskets 48 and 32 on opposite sides of the line 54, the gasket seal test system 20 is able to test whether gasket 32 creates a fluid tight seal between the wellhead 14 and the tree 16. For example, the test system 20 may force seawater through line 54 creating pressure on the gasket 32, e.g., approximately 10,000-50,000 psi, 15,000-30,000 psi, or 20,000-40,000 psi, or any suitable pressure based on expected production pressures. This pressure testing determines whether the gasket 32 will maintain a fluid tight seal during oil extraction. Similarly, the gaskets 50 and 52 create fluid tight seals around the production aperture 38 to block flow to/from the output production system 18 during downhole procedures.

As mentioned above, the well is plugged until after the installation of the mineral extraction system 10. After installation of the extraction system 10 and testing of the gasket 32, additional downhole procedures may be performed, e.g., a drill may pass through the aperture 46 to a downhole position to release the oil. During these downhole procedures, the bore protection portion 44 protects the tree 16 from damage, for example, during the insertion and withdrawal of the drill bit. Thus, the sleeve 12 advantageously protects the tree 16 from damage during downhole operations, while sealing off the production outlet 38 and permitting testing of gasket 32.

Once oil production is ready to begin, the sleeve 12 may be extracted. For example, removal tool 22 may attach to the sleeve 12 and pull the sleeve 12 out of the bore apertures 26, 36. Advantageously, because the sleeve 12 combines the gasket test isolation portion 42 with the bore protector portion 44 both portions are capable of extraction together as a single unit without the tree 16 or wellhead 14. Furthermore, because both portions 42, 44 are extractable they may be reused at a different location with another extraction system 10. This reusability of both sleeve portions 42 and 44 reduces cost.

Figure 2:
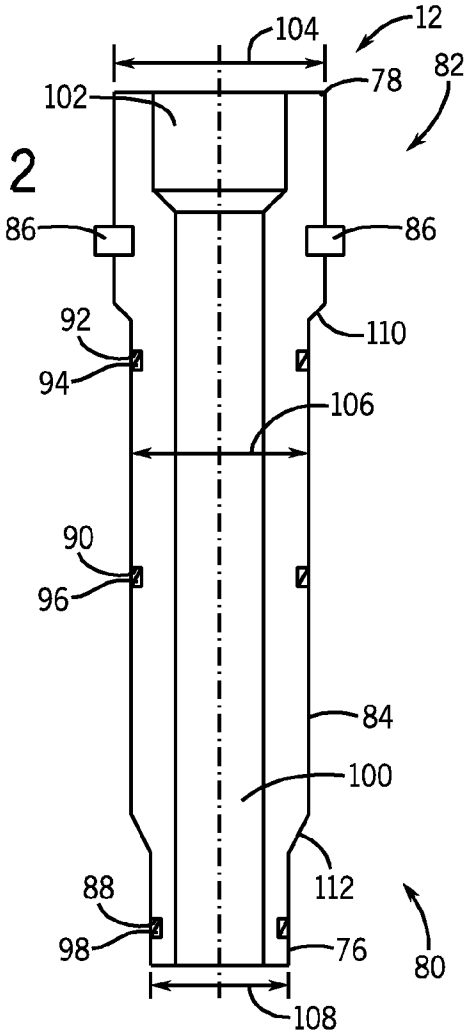
FIG. 2 is a cross-sectional side view of an embodiment of a gasket test protector sleeve.

FIG. 2 is a cross-sectional side view of an embodiment of a gasket test protector sleeve 12. The sleeve 12 includes a first upstream end 76; a second downstream end 78; a gasket test isolation portion 80; a bore protection portion 82; an exterior surface 84; a locking mechanism 86; gasket apertures 88, 90, and 92; gaskets 94, 96, and 98; central aperture 100 (e.g., downhole procedures aperture); and a retrieval tool counterbore 102. In addition, the sleeve 12 defines three sleeve thickness diameters 104, 106, and 108. The three diameters 104, 106, and 108 create angled ledges 110 and 112 as the diameters transition from one to the other. These ledges 110 and 112 allow the sleeve 12 to fit in and connect to a tree and wellhead (shown in FIGS. 3 and 4). As explained above, the gasket test protector sleeve 12 advantageously combines the gasket test isolation portion 80 with the bore protection portion 82. Again, the gasket test isolation portion 80 is configured to seal a test region around a gasket, thereby allowing pressure testing. The bore protection portion 82 seals off a production outlet (e.g., lateral outlet 38) while protecting the tree and wellhead during downhole procedures. After gasket testing and downhole procedures, the sleeve 12 is extracted with both portions 80 and 82 as a single integrated unit, which is independent from the tree and wellhead.

Figure 3:
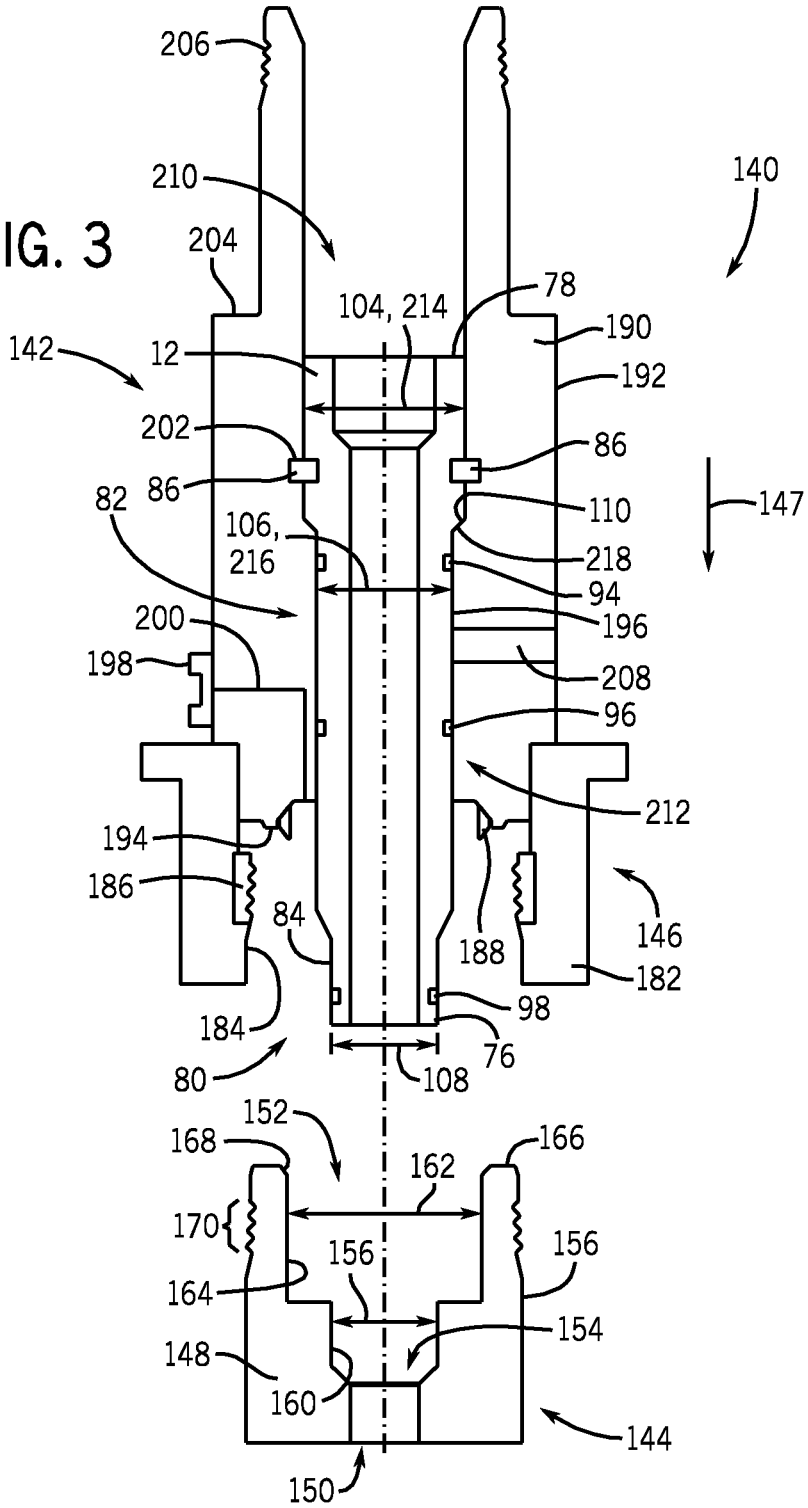
FIG. 3 is a cross-sectional side view of an embodiment of a tree with a gasket test protector sleeve being lowered onto a wellhead.

FIG. 3 is a cross-sectional side view of an embodiment of a mineral extraction system 140 with a tree 142 and gasket test protector sleeve 12 being lowered onto a wellhead 144. The mineral extraction system 140 includes the tree 142 (e.g., first tubular), the gasket test protector sleeve 12, the wellhead 144 (e.g., second tubular), and a tree connector 146. As illustrated, the tree 142 moves in the direction of arrow 147 towards the wellhead 144, such that the tree 142 and wellhead 144 connect with one another (see FIG. 4).

The wellhead 144 includes a body portion 148, an aperture 150, a first counterbore 152, a second counterbore 154, and an exterior surface 156. The aperture 150 permits a natural resource to move between a well and the tree 146. In the present embodiment, the aperture 150 may be similar in size to the aperture 100 of the sleeve 12. In other embodiments, the apertures 100 and 150 may not match one another, but may differ in size with respect to one another. As illustrated, the second counterbore 154 defines a diameter 158 and a surface 160. The diameter 158 substantially matches the diameter 108 of the first end 76 of the sleeve 12. Accordingly, when the tree 142 connects to the wellhead 144 the second counterbore 154 receives and aligns the sleeve 12 at the first end 76. The first counterbore 152 defines a diameter 162 and an annular surface 164. The diameter 162 may be larger than the sleeve diameters 106 or 108. This creates space between the gasket test isolation portion 80 and the wellhead 144 as discussed below. More specifically, it creates space between the exterior surface 84 and the first counterbore surface 164. This space permits testing of the connection between the tree 142 and the wellhead 144. Furthermore, the wellhead 144 includes a tree contact surface 166 (e.g., axial abutment surface), a gasket contact surface 168 (e.g., wedged or tapered surface), and a threaded portion 170 (e.g., male threads).

As explained above, the extraction system 10 includes the tree connector 146. As illustrated, the tree connector 146 attaches to the tree 142, and enables connection between the tree 142 and the wellhead 144. The tree connector 146 includes a body 182 with an interior surface 184 and a threaded portion 186 (e.g., female threads). Accordingly, the tree 142 establishes a connection to the wellhead 144 by rotating the threaded portion 186 of the tree connector 146 about the threaded portion 170 of the wellhead 144.

The tree 142 includes a gasket 188 and defines a body 190. The body 190 defines an exterior surface 192, a wellhead connection surface 194, a bore aperture 196, a gasket seal test system 198, line 200, locking mechanism apertures 202, connection ledge 204, thread portion 206 (e.g., male threads), and production aperture 208 (e.g., lateral production outlet). As illustrated, the bore aperture 196 receives the sleeve 12. The bore aperture 196 includes a first portion 210 and a second portion 212 with different diameters configured to support the sleeve 12. In particular, the first portion 210 defines a diameter 214, while the second portion defines a diameter 216. As the bore aperture 196 transitions between the two portions 210 and 212 (i.e., the different diameters 214, 216), the change creates an angled bore ledge portion 218 (e.g., tapered portion). As illustrated, the first diameter 214 is substantially equal to the sleeve diameter 104, while the second diameter 216 is substantially equal to the sleeve diameter 106. Thus, as the sleeve 12 is inserted into the bore aperture 196, the sleeve diameters 106 and 108 are able to pass through the first and second portions 210 and 212 until the sleeve ledge 110 contacts the bore ledge 218 (i.e., sleeve mounting region) at a tapered interface (e.g., conical interface). The contact between theses ledges 110 and 218 suspends the sleeve 12 at a proper position within the tree 142. Once properly positioned the sleeve 12, locking mechanism 86 engages the apertures 202 locking the sleeve 12 into place. In some embodiments, the locking mechanism 86 may be actuated by a running tool (e.g., tool 22 of FIG. 1).

Figure 4:
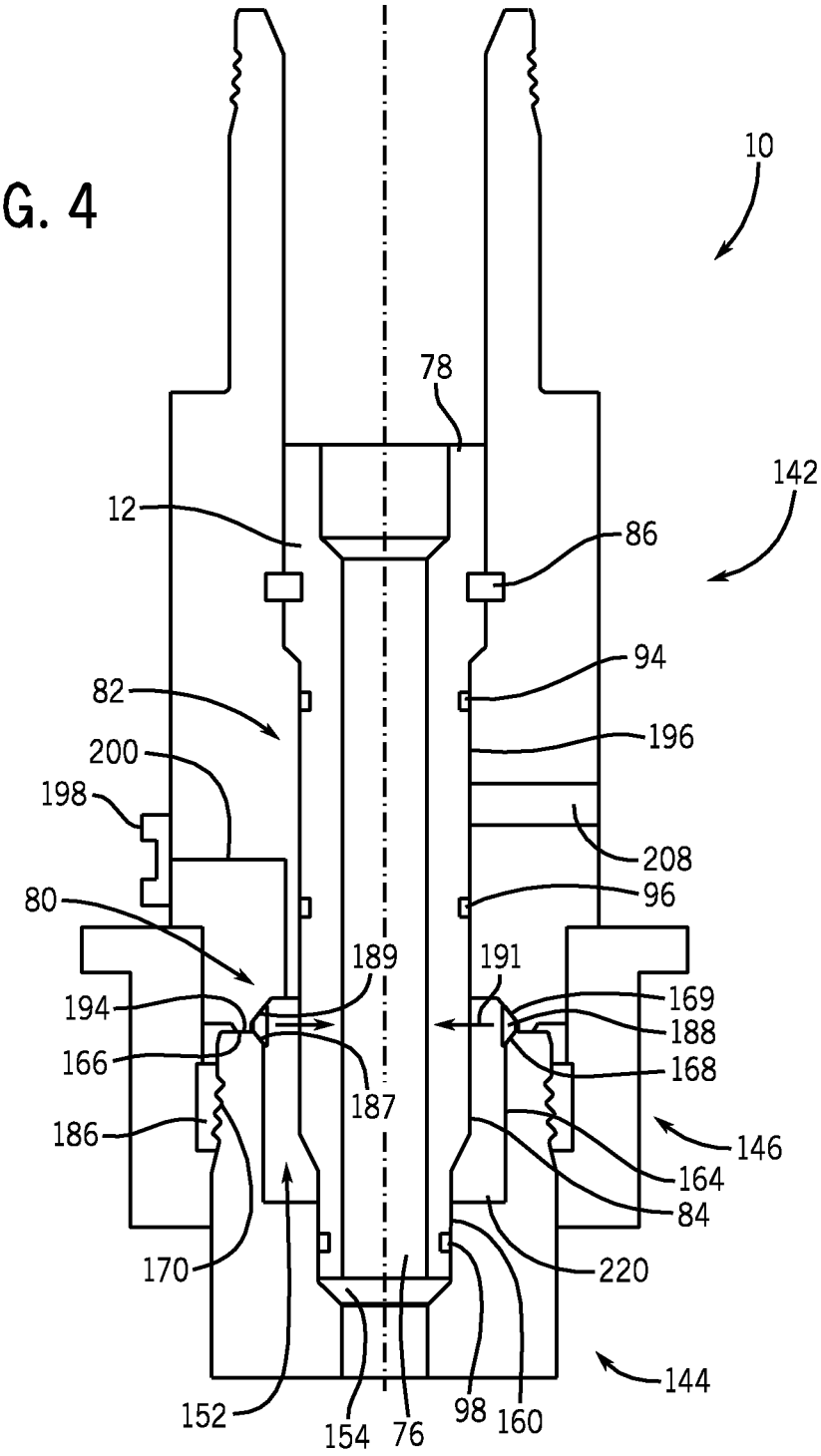
FIG. 4 is a cross-sectional side view of an embodiment of a tree with a gasket test protector sleeve attached to a wellhead.

FIG. 4 is a cross-sectional side view of an embodiment of the tree 142 attached to the wellhead 144 with the gasket test protector sleeve 12 in position. As illustrated, the threaded portion 186 of the tree connector 146 threads onto the threaded portion 170 of the wellhead 144 until the wellhead contact surface 194 rests on the tree contact surface 166. As these two surfaces 166, 194 contact one another; tapered surfaces 168 and 169 axially compress the gasket 188 along corresponding tapered surfaces 187 and 189, thereby biasing the gasket in a radial inward direction 191. Thus, the gasket 188 provides both an axial force and a radial outward force to provide a seal between the tree 142 and the wellhead 144.

During the connection, the sleeve 12 likewise makes a fluid tight connection with the wellhead 144. Specifically, the sleeve end 76 enters the second counterbore 154 of the wellhead 144. With the sleeve end 76 within the counterbore 154, the gasket 98 is able to create a fluid tight seal between the sleeve 12 and the counterbore surface 160. Similarly, the gaskets 94 and 96 are able to create fluid tight seals between the sleeve 12 and tree's 142 bore aperture 196. Thus, the sleeve 12 and its gaskets 94, 96, and 98, enable testing of the gasket 188 between the tree 142 and the wellhead 144.

As explained previously, the first counterbore 152 is larger than the sleeve diameters 106, 108. More specifically, the counterbore 152 defines a diameter larger than the gasket test isolation portion 80. This creates a space 220 between the sleeve surface 84 and the counterbore surface 164. With the gaskets 98 and 96 on opposite sides of the line 200, the gasket seal test system 198 is able to test whether gasket 188 creates a fluid tight seal between the wellhead 144 and the tree 142. Specifically, test system 198 may force seawater through line 200 into the space 220 to create pressure on the gasket 188. For instance, the test system 198 may create pressures within the space 220 of approximately 10,000-50,000 psi, 15,000-30,000 psi, or 20,000-40,000 psi. This pressure testing determines whether the gasket 188 will likely fail or maintain a fluid tight seal during oil extraction, thereby allowing repair if needed to avoid any potential oil leakage into the environment. Similarly, the gaskets 94 and 96 create fluid tight seals around the production aperture 208. This allows testing of an output production system (not shown) before oil extraction operations. In other embodiments, there may be more than three gaskets, e.g., 3, 4, 5, 6, 7, 8, 9, 10, or more gaskets along the sleeve 12. These additional gaskets may provide duplicate sealing ability in the event that one of the gaskets 94, 96, and 98 are unable to provide a fluid tight seal. For example, there may be a pair of gaskets dedicated to sealing the gasket 188, and a separate pair of gaskets dedicated to sealing the production aperture 208.

Before or after testing of the gasket 188, additional downhole procedures may be performed, e.g., a drill or other equipment may pass through the tree 142 and into the well. During these additional downhole procedures, the sleeve 12 (e.g., the bore protection portion 82) protects the tree 142 from damage, e.g., during the insertion and withdrawal of a drill bit or other equipment. Thus, the sleeve 12 advantageously protects the tree 142 from damage during additional downhole operations, while allowing testing of gasket 188. Furthermore, the bore protection portion 82 isolates the production outlet 208 (e.g., lateral outlet from the bores of the tree 142 and the wellhead 144). For example, the bore protection portion 82 overlaps the outlet 208, while the seals or gaskets 94 and 96 block fluid flow between the outlet 208 and the tree 142 and wellhead 144.

Figure 5:
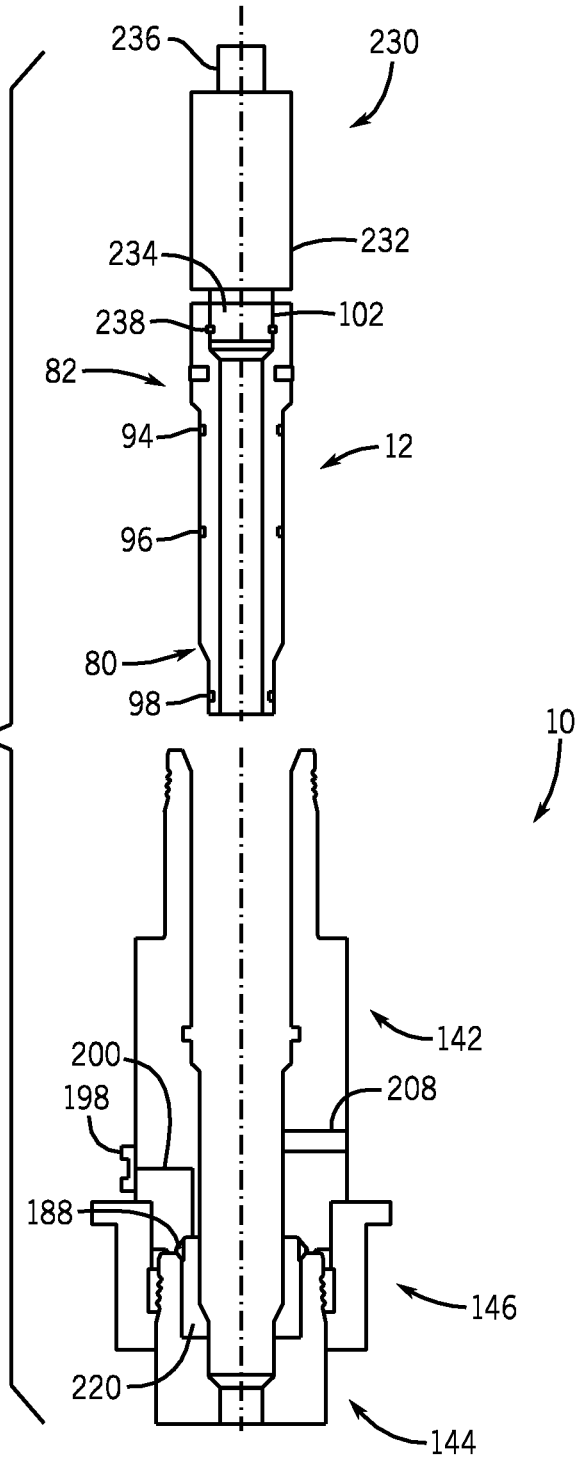
FIG. 5 is a cross-sectional side view of an embodiment of a tree attached to a wellhead with the gasket test protector sleeve being extracted.

FIG. 5 is a cross-sectional side view of an embodiment of the tree 142 attached to the wellhead 144 with the gasket test protector sleeve 12 being extracted with a running tool 230. The running tool 230 includes a body portion 232, a sleeve connector portion 234, and a cable-connecting portion 236. In order to connect and pull the sleeve 12 out of the tree 142, the connector portion 234 includes a locking mechanism 238. The locking mechanism 238 connects to and locks the sleeve 12 to the running tool 230 for recovery. In particular, the sleeve connector portion 234 slides into the sleeve's 12 counterbore 102, wherein the locking mechanism 238 engages the sleeve 12.

As mentioned above, the sleeve 12 advantageously combines the gasket test isolation portion 80 with the bore protector portion 82 as a single integrated unit, which is extractable independent from the tree 142 and the wellhead 144. The combination permits extraction of both portions from the tree 142 and wellhead 144, whereas previously this was not possible. Thus, once oil production is ready to begin, the sleeve 12 may be extracted removing both portions 80 and 82. Once removed, the sleeve 12 may then be reused at a different location. Similarly, in the event that the testing system 198 is unable to build pressure in space 220, the recovery of sleeve 12 permits inspection of the seals 94, 96, and 98 to ensure that these seals are not the cause of the pressure failure. Otherwise, failure to pass a gasket test would involve removal of the entire tree 142, a much more time consuming and costly procedure. Instead, by advantageously combining the portions 80, 82, seal inspection is possible before removal of the entire tree 142.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a one-piece gasket test protector sleeve comprising a gasket test isolation portion and a bore protection portion, wherein the gasket test isolation portion comprises a first seal and a second seal configured to isolate a gasket between a first tubular and a second tubular of a subsea mineral extraction system, the gasket test isolation portion is configured to receive a pressurized fluid to test an integrity of the gasket, and the bore protection portion is configured to protect a first bore of the first tubular during downhole procedures.

2. The system of claim 1, wherein the bore protection portion is configured to isolate a lateral outlet in the first tubular.

3. The system of claim 1, wherein the one-piece gasket test protector sleeve is retrievable independent from the first tubular and the second tubular.

4. The system of claim 1, comprising a locking mechanism located on an outer circumference of the one-piece gasket test protector sleeve and configured to secure the one-piece gasket test protector sleeve to the first tubular, wherein the locking mechanism is configured to be actuated by a running tool.

5. The system of claim 1, comprising the first tubular having the one-piece gasket test protector sleeve.

6. The system of claim 5, wherein the first tubular comprises a subsea tree of the mineral extraction system.

7. The system of claim 6, comprising the second tubular, wherein the second tubular comprises a wellhead.

8. The system of claim 1, wherein the bore protection portion comprises the second seal and a third seal disposed on opposite sides of a lateral outlet in the first tubular.

9. A system, comprising:

a first tubular of a subsea mineral extraction system;

a second tubular coupled to the first tubular;

a gasket between the first tubular and the second tubular, wherein the gasket is configured to create a seal between the first tubular and the second tubular;

a one-piece subsea sleeve comprising a gasket test isolation portion;

a locking mechanism located on an outer circumference of the one-piece subsea sleeve, wherein the locking mechanism is configured to secure the one-piece subsea sleeve to the first tubular, and the locking mechanism is configured to be actuated by a running tool; and one or more seals, wherein the one or more seals enable the gasket test isolation portion to isolate the gasket and receive a pressurized fluid between the first tubular and the second tubular to test an integrity of the gasket.

10. The system of claim 9, comprising the running tool.

11. The system of claim 9, wherein the one-piece subsea sleeve is retrievable independent from the first tubular and the second tubular.

12. The system of claim 9, wherein the first tubular comprises a subsea tree of the mineral extraction system.

13. The system of claim 9, wherein the one-piece subsea sleeve comprises a bore protection portion configured to protect a first bore of the first tubular during downhole procedures.

14. The system of claim 9, wherein the one-piece subsea sleeve comprises a bore protection portion configured to isolate a lateral outlet of the first tubular.

15. The system of claim 14, wherein the one or more seals are configured to isolate the gasket and the lateral outlet from a first bore of the first tubular and a second bore of the second tubular.

16. A system, comprising:

a subsea tree of a mineral extraction system, wherein the subsea tree is configured to couple with a wellhead, the subsea tree comprises:

a tree bore;

a test port in fluid communication with the tree bore;

a sleeve mounting region along the tree bore;

a lateral production outlet along the sleeve mounting region; and a gasket, wherein the gasket is configured to create a fluid tight seal between the subsea tree and the wellhead, the sleeve mounting region is configured to receive a one-piece gasket test protector sleeve, and the one-piece gasket test protector sleeve is configured to isolate the lateral production outlet and the gasket to test an integrity of the gasket with a fluid pumped through the test port.

17. The system of claim 16, comprising the one-piece gasket test protector sleeve disposed in the sleeve mounting region.

18. The system of claim 17, comprising a locking mechanism located on an outer circumference of the one-piece gasket test protector sleeve, wherein the locking mechanism is configured to secure the one-piece gasket test protector sleeve to the subsea tree, and the locking mechanism is configured to be actuated by a running tool.

19. The system of claim 1, comprising a test port configured to deliver the pressurized fluid through a subsea tree.

* * * * *